US006013986A

United States Patent [19]

Knall et al.

[11] Patent Number: 6,013,986

[45] Date of Patent: Jan. 11, 2000

[54] ELECTRON-EMITTING DEVICE HAVING MULTI-LAYER RESISTOR

[75] Inventors: N. Johan Knall, Sunnyvale, Calif.; Duane A. Haven, Umpqua, Oreg.; Swayambu Ramani, San Jose, Calif.

[73] Assignee: Candescent Technologies Corporation, San Jose, Calif.

[21] Appl. No.: 08/884,702

[22] Filed: Jun. 30, 1997

[51] Int. Cl.[7] ..... H01J 63/04

[52] U.S. Cl. ..... 315/169.3; 313/309; 313/495

[58] Field of Search ..... 313/495, 336, 313/309, 351; 315/169.3

[56] References Cited

U.S. PATENT DOCUMENTS

| | | | |
|---|---|---|---|
| 4,940,916 | 7/1990 | Borel et al. | 313/306 |
| 5,096,662 | 3/1992 | Yamamoto et al. | 419/9 |
| 5,142,184 | 8/1992 | Kane | 313/309 |
| 5,162,704 | 11/1992 | Kobori et al. | 315/349 |
| 5,194,780 | 3/1993 | Meyer | 315/169.3 |
| 5,458,520 | 10/1995 | DeMercurio et al. | 445/24 |
| 5,559,389 | 9/1996 | Spindt et al. | 313/310 |
| 5,564,959 | 10/1996 | Spindt et al. | 445/24 |
| 5,587,623 | 12/1996 | Jones | 313/497 |
| 5,592,056 | 1/1997 | Peyre et al. | 315/169.1 |
| 5,594,298 | 1/1997 | Itoh et al. | 313/336 |
| 5,619,097 | 4/1997 | Jones | 313/495 |
| B1 4,940,916 | 11/1996 | Borel et al. | 315/306 |

*Primary Examiner*—David H. Vu

*Attorney, Agent, or Firm*—Skjerven, Morrill MacPherson, Franklin & Friel LLP; Ronald J. Meetin

[57] ABSTRACT

An electron-emitting device employs a multi-layer resistor (46). A lower layer (48) of the resistor overlies an emitter electrode (42). A set of electron-emissive elements (54) overlie an upper layer (50) of the resistor. Each resistive layer extends continuously from a location below each electron-emissive element to a location below each other electron-emissive element. The two resistive layers are of different chemical composition. The upper resistive layer is typically formed with cermet. The lower resistive layer is typically formed with a silicon-carbon compound.

32 Claims, 4 Drawing Sheets

ELECTRON-EMITTING DEVICE HAVING MULTI-LAYER RESISTOR

FIELD OF USE

This invention relates to resistors. More particularly, this invention relates to the structure and fabrication of an electron-emitting device in which electrically resistive material is situated between electron-emissive elements, on one hand, and emitter electrodes, on the other hand, and which is suitable for use in a flat-panel display of the cathode-ray tube ("CRT") type.

BACKGROUND

A flat-panel CRT display basically consists of an electron-emitting device and a light-emitting device that operate at low internal pressure. The electron-emitting device, commonly referred to as a cathode, contains electron-emissive elements that emit electrons over a wide area. The emitted electrons are directed towards light-emissive elements distributed over a corresponding area in the light-emitting device. Upon being struck by the electrons, the light-emissive elements emit light that produces an image on the viewing surface of the display.

When the electron-emitting device operates according to field-emission principles, electrically resistive material is commonly placed in series with the electron-emissive elements to control the magnitude of current flow through the electron-emissive elements. FIG. 1 illustrates a conventional field-emission device, as described in U.S. Pat. 5,564,959, that so utilizes resistive material. In the field emitter of FIG. 1, electrically resistive layer 10 overlies emitter electrodes 12 provided on baseplate 14. Gate layer 16 is situated on dielectric layer 18. Conical electron-emissive elements 20 are situated on emitter resistive layer 10 in openings 22 through dielectric layer 18 and are exposed through corresponding openings 24 in gate layer 16.

One of the materials employed for resistive layer 10 is a ceramic-metal composite, commonly referred to as cermet, in which metal particles are embedded in ceramic. Cermet is an attractive resistive material. Electron-emissive cones 20, especially when they are formed with molybdenum, adhere well to the cermet. Also, the cermet serves as an etch stop in forming dielectric openings 22 that house cones 20.

Cermet normally has highly non-linear current-voltage ("I–V") characteristics. This can negatively impact the ability to fabricate a flat-panel display so as to have high performance. Accordingly, it is desirable to have an emitter resistor that achieves the advantages of cermet but overcomes the disadvantages associated with cermet's highly non-linear I–V characteristics.

GENERAL DISCLOSURE OF THE INVENTION

The present invention furnishes a resistor configured in multiple layers to achieve desired characteristics, especially characteristics that enhance the manufacturability and performance of an electron-emitting device containing electron-emissive elements located in series with the resistor. In a basic aspect of the invention, a lower layer of the resistor overlies an electrically conductive emitter electrode. An upper layer of the resistor overlies the lower layer. The two resistive layers are of different chemical composition. An electron-emissive element overlies the upper resistive layer.

The I–V characteristics of one of the resistive layers are usually closer to being linear than the I–V characteristics of the other resistive layer. As used here, "linear" means that the rate at which current flowing through an element changes with voltage across the element is constant. Since voltage is the product of current and resistance, the resistance of the resistive layer with the less linear I–V characteristics usually varies more with voltage (or current) than the resistance of the resistive layer with the more linear I–V characteristics.

The I–V characteristics of the two resistive layers can conveniently be described in terms of a crossover voltage value and a transition voltage value. Consider the typical situation in which the lower resistive layer has the more linear I–V characteristics.

The I–V characteristics of the two resistive layers preferably cross over each other when the voltage across the two resistive layers is between zero and an upper value that the resistor voltage can reach during normal operation of the device. The crossover occurs at the crossover voltage value. Specifically, the lower resistive layer (a) is of lower resistance than the upper resistive layer when the resistor voltage is between zero and the crossover value and (b) is of higher resistance than the upper layer when the resistor voltage is between the crossover value and the upper operating value.

The transition voltage value lies between zero and the crossover voltage value. The resistance of the upper resistive layer (the less linear resistive layer here) typically undergoes a drastic change in value when the resistor voltage is in the vicinity of the transition value. For example, the resistance of the upper resistor typically drops by at least a factor of 10 as the resistor voltage goes from the upper transition operating value to the upper operating value.

Arranging for the I–V characteristics of the resistive layers do have the preceding resistive properties enables the lower resistive layer (the more linear resistive layer here) to dominate the I–V characteristics of the overall resistor when the resistor voltage exceeds the transition value. The I–V characteristics of the overall resistor can thus be made closer to linear in the resistor voltage regime from the transition value to the upper operating value even though the I–V characteristics of the upper resistive layer may be highly non-linear, especially when the resistor voltage is between zero and the transition value.

For a given set of materials that form the two resistive layers, the I–V characteristics of the overall resistor are controlled by appropriately adjusting the thicknesses of the layers. In the resistor voltage regime between the transition value and the upper operating value, the I–V characteristics of the overall resistor become progressively more linear as the lower resistive layer is progressively increased in thickness relative to the upper resistive layer.

Increasing the linearity of the overall I–V characteristics in the regime above the transition voltage value normally enhances the performance of the electron-emitting device. Specifically, should the electron-emissive element becomes electrically shorted to an overlying gate layer, the resulting short-circuit current which flows through the electron-emissive element and the resistor can be readily limited to a value that causes little performance deterioration. The fact that the upper resistive layer is of greater resistance than the lower resistive layer in the positive voltage regime below the transition value normally does not cause serious performance degradation.

With the I–V characteristics established in the foregoing way, the I–V characteristics of the overall resistor are partially decoupled from those of the upper resistive layer. This permits other characteristics of the upper resistive layer to be chosen in a way that achieves other desirable features. Consequently, the I–V characteristics of the present resistor are especially beneficial.

As one desirable feature, the upper resistive layer provides two mechanisms for inhibiting galvanic corrosion of the electron-emissive element when the electron-emitting device is placed in an electrolytic bath during device fabrication. Firstly, the upper resistive layer can readily be made of material that does not itself cause galvanic corrosion of the electron-emissive element even though the material of the lower resistive layer might, if it were in contact with the electron-emissive element, cause galvanic corrosion of the electron-emissive element. Secondly, the upper resistive layer can readily prevent the emitter electrode from galvanically corroding the electron-emissive element.

Also, the electron-emissive element is typically situated in an opening extending through a dielectric layer that overlies the emitter electrode. In etching the opening through the dielectric layer, the characteristics of the upper resistive layer are chosen in such a way that the etchant attacks the dielectric material much more than the upper resistive material. The upper resistive layer than serves as an etch stop to prevent the lower resistive layer and the emitter electrode from being etched as an unintended consequence of etching the dielectric layer.

The upper resistive layer is typically formed with cermet in which metal particles are embedded in ceramic. The cermet provides the corrosion resistance and performs the etch-stop function during the etching of the opening through the dielectric layer. The lower resistive layer is typically formed with a silicon-carbon compound having relatively linear I–V characteristics. The cermet/silicon-carbon combination strongly inhibits short circuiting of the control electrode to the emitter electrode through the dielectric layer. With the silicon-carbon compound being considerably thicker than the cermet in the resistor of the invention, the present resistor achieves the advantages of the prior art cermet resistor but avoids its disadvantages.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

In the present invention, a vertical resistor connected in series with electron-emissive elements of an electron-emitting device is configured in at least two layers to achieve desired current-voltage characteristics, to avoid galvanic corrosion, to facilitate device fabrication, and to reduce current through electrically shorted electron-emissive elements during normal operation of the device. The electron emitter of the invention typically operates according to field-emission principles in producing electrons that cause visible light to be emitted from corresponding light-emissive phosphor elements of a light-emitting device. The combination of the electron-emitting and light-emitting devices forms a cathode-ray tube of a flat-panel display such as a flat-panel television or a flat-panel video monitor for a personal computer, a lap-top computer, or a workstation.

In the following description, the term "electrically insulating" (or "dielectric") generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/$\mu$m.

Examples of electrically conductive materials (or electrical conductors) are metals, metal-semiconductor compounds (such as metal silicides), and metal-semiconductor eutectics. Electrically conductive materials also include semiconductors doped (n-type or p-type) to a moderate or high level. The semiconductors may be of the monocrystalline, multicrystalline, polycrystalline, or amorphous type.

Electrically resistive materials include (a) metal-insulator composites such as cermet, (b) certain silicon-carbon compounds such as silicon-carbon-nitrogen, (c) forms of carbon such as graphite, amorphous carbon, and modified (e.g., doped or laser-modified) diamond, and (d) semiconductor-ceramic composites. Further examples of electrically resistive materials are intrinsic and lightly doped (n-type or p-type) semiconductors.

Figure 2:
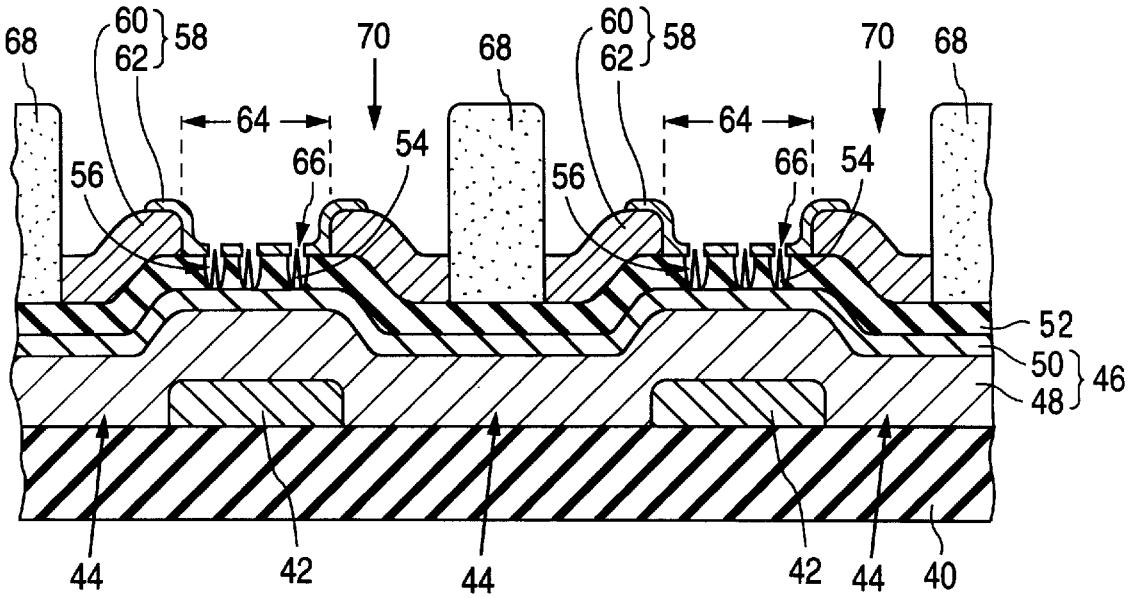
FIG. 2 is a cross-sectional view of the core of an electron-emitting device provided with a two-layer vertical emitter resistor in accordance with the invention.

Referring to FIG. 2, it illustrates the core of a matrix-addressed electron-emitting device that contains a vertical emitter resistor configured according to the invention. The device in FIG. 2 operates in the field-mission mode and is often referred to here as a field emitter.

The field emitter of FIG. 2 is created from a thin transparent flat baseplate 40 typically consisting of glass such as Schott D263 glass having a thickness of approximately 1 mm. A group of parallel emitter electrodes 42 are situated on baseplate 40. Each emitter electrode 42 is, in plan view, generally shaped like a ladder having crosspieces separated by emitter openings 44. The crosspieces for one emitter electrode 42 are shown in FIG. 2. Electrodes 42 are typically formed with an alloy of nickel or aluminum to a thickness of 200 nm.

An electrically resistive layer 46 overlies emitter electrodes 42. Resistive layer 46 is a vertical resistor in that positive current flows through resistor 46 largely in the vertical direction between emitter electrodes 42 and overlying electron-emissive elements, described below. The direction of (positive) current flow in FIG. 2 is downward during normal operation of the field emitter. Vertical resistor 46 has properties that provide a number of important functions.

The overall I–V characteristics of emitter resistor 46 in the vertical direction are substantially non-linear. However, the vertical I–V characteristics of resistor 46 are arranged so as to be relatively linear when the voltage $V_R$ across the thickness of resistor 46 varies between a selected positive lower operating value $V_{RL}$ and a selected positive upper operating value $V_{RU}$. Let $R_R$ represent the vertical resistance that resistor 46 presents to current flowing through an electron-emissive element. Total vertical resistance $R_R$ is thus relatively constant when resistor voltage $V_R$ is in the regime from lower operating value $V_{RL}$ to upper operating value $V_{RU}$. Letting $R_{RN}$ be the nominal value of resistance $R_R$ when voltage $V_R$ is at approximately the middle of the $V_{RL}$-to-$V_{RU}$ regime, nominal resistance value $R_{RN}$ is usually $10^6$–$10^{11}$ ohms, typically $10^9$ ohms.

Picture elements (pixels) in the flat-panel display normally have multiple levels of gray-scale brightness. Voltage level $V_{RL}$ is typically the operating value of resistor voltage $V_R$ that occurs at the minimum pixel brightness level during normal display operation. As described further below, the emission of electrons from an electron-emissive element is controlled by the voltage between (a) a gate portion through which that electron-emissive element is exposed and (b) the underlying emitter electrode 42. For a typical maximum gate-to-emitter voltage of 35 volts, $V_{RL}$ is desirably 1 volt.

Vertical resistance $R_R$ normally increases as emitter voltage $V_R$ drops below lower operating value $V_{RL}$, and begins to increase greatly as voltage $V_R$ drops below a transition value $V_{RT}$ less than $V_{RL}$. The vertical I–V characteristics of resistor 46 are thus substantially non-linear in the $V_R$ regime between zero and transition value $V_{RT}$. Transition value $V_{RT}$ is 0.1–1.5 volts, typically 0.5 volt.

During normal display operation, an electron-emissive element is sometimes electrically shorted to its gate portion. The fraction of electron-emissive elements electrically shorted in this manner is normally small. When an electron-emissive element is shorted to its gate portion, substantially the entire gate-to-emitter voltage is present across the underlying part of resistor 46. Upper operating value $V_{RU}$ is typically the maximum value of the gate-to-emitter voltage. Accordingly, $V_{RU}$ is typically 35 volts.

The vertical I–V characteristics of resistor 46 are roughly symmetrical about the zero-$V_R$ point. That is, resistance $R_R$ is in the vicinity of nominal value $R_R$ N when resistor voltage $V_R$ is between $-V_{RU}$ and $-V_{RL}$. Similarly, resistance $R_R$ normally increases as voltage $V_R$ rises above $-V_{RL}$, and begins to increase greatly when voltage $V_R$ rises above $-V_{RT}$. As discussed further below, the high $R_R$ value in the $V_R$ regime from zero to $-V_{RT}$ can be taken advantage of to facilitate removal of excess emitter material deposited on the field emitter during fabrication of the electron-emissive elements.

As likewise discussed below, resistor 46 is constructed to function as an etch stop during the formation of openings in which the electron-emissive elements are formed. Resistor 46 is also configured to inhibit galvanic corrosion of the electron-emissive elements during display fabrication.

To achieve the foregoing benefits, vertical resistor 46 is configured as a blanket lower electrically resistive layer 48 and a blanket upper electrically resistive layer 50. Lower resistive layer 48 lies on the top of, and makes good ohmic contact to, emitter electrodes 42. The ohmic contact between lower resistive layer 48 and emitter electrodes 42 may be achieved through a thin interfacial layer formed with the materials of resistive layer 48 and electrodes 42. Resistive layer 48 also contacts portions of baseplate 40 through emitter openings 44 and to the sides of electrodes 42. Upper resistive layer 50 lies on top of, and ohmically contacts, lower resistive layer 48.

Voltage $V_R$ across the thickness of resistor 46 is actually the voltage (difference) between (a) an electron-emissive element overlying resistor 46 and (b) the emitter electrode 42 underlying resistor 46 below that electron-emissive element. Due to lateral current spreading in resistive layers 48 and 50, there is no single value of voltage present across the thickness of lower resistive layer 48 (or upper resistive layer 50) when resistor voltage $V_R$ is at a non-zero value. In other words, the voltage at the interface between layers 48 and 50 varies from point to point along the intra-resistor interface. In light of this, the vertical I–V characteristics of layers 48 and 50 are described below largely in terms of voltage $V_R$ even though only a portion of voltage $V_R$ is present across the thickness of layer 48 or 50.

Lower resistive layer 48 consists of electrically resistive material that provides relatively linear I–V characteristics for current generally flowing vertically through the thickness of layer 48 either downward or upward as resistor voltage $V_R$ varies in magnitude between zero and upper operating value $V_{RU}$ and between negative value $-V_{RU}$ and zero. Let $R_L$ represent the vertical resistance that lower resistive layer 48 presents to current flowing through an electron-emissive element. Lower vertical resistance $R_L$ is largely constant as voltage $V_R$ varies across the regime from $-V_{RU}$ to $V_{RU}$. The nominal value $R_{LN}$ of lower resistance $R_L$ is approximately $10^6$–$10^{11}$ ohms, typically $10^9$ ohms, when voltage $V_R$ is halfway between $V_{RL}$ and $V_{RU}$.

An electrically resistive material suitable for lower resistive layer 48 is a silicon-carbon compound such as silicon-carbon-nitrogen. When the silicon-carbon-nitrogen compound consists of 72% silicon, 13% carbon, and 15% nitrogen by weight, the thickness of layer 48 is usually 0.1–1.0 $\mu$m, typically 0.3 $\mu$m. Although not shown in FIG. 2, a thin metal-silicon layer formed with the metal (e.g., again typically nickel or aluminum) of emitter electrodes 42 and the silicon in the silicon-carbon-nitrogen of layer 48 may be present along part or all of the interface between layer 48 and electrodes 42 to provide ohmic contact between layer 48 and electrodes 42. Lower resistive layer 48 can alternatively or additionally be formed with aluminum nitride, gallium nitride, and/or intrinsic amorphous silicon.

Upper resistive layer 50 consists of electrically resistive material that provides highly non-linear I–V characteristics for current generally flowing vertically through the thickness of resistive layer 50 either upward or downward. Let $R_U$ represent the vertical resistance that layer 50 presents to current flowing through an electron-emissive element. The nonlinear vertical I–V characteristics of layer 50 are of such a nature that upper vertical resistance $R_U$ is very high, considerably greater than nominal lower resistance value $R_{LN}$, when the magnitude of resistor voltage $V_R$ is less than transition value $V_{RT}$. Resistance $R_U$ drops sharply when the magnitude of voltage $V_R$ rises above $V_{RT}$ and reaches a value considerably less than $R_{LN}$ when voltage $V_R$ is at $V_{RU}$. Resistance $R_U$ is typically at least 10 times lower when voltage $V_R$ is at $V_{RU}$ than when voltage $V_R$ is at $V_{RT}$. The vertical I–V characteristics of layer 50 are roughly symmetrical about the zero-$V_R$ point.

A suitable electrically resistive material for upper resistive layer 50 is cermet in which relatively small metal particles are distributed in a relative uniform manner throughout a ceramic substrate. The metal particles usually constitute 10–80%, preferably 30–60%, of the cermet by weight. The ceramic forms nearly all of the remainder of the cermet. Hence, the ceramic usually constitutes 20–90%, preferably 40–70%, of the cermet by weight.

The metal particles typically consist of chromium. Silicon oxide, primarily in the form of $SiO_2$, is typically the ceramic.

A typical formulation for the cermet is 45 wt % chromium and 55 wt % silicon oxide. For this formulation, the thickness of layer 50 is 0.01–0.2 $\mu$m, typically 0.05 $\mu$m. Since the thickness of lower resistive layer 48 is 0.1–1.0 $\mu$m, typically 0.3 $\mu$m, when layer 48 consists of silicon-carbon-nitrogen, lower resistive layer 48 is typically considerably thicker than upper resistive layer 50.

The metal particles can be formed with metals other than chromium. Candidate alternative metals include nickel, tungsten, gold, and tantalum. Other transition, refractory, and/or nobel metals can also be utilized in the metal particles. The metal particles can be formed with two or more metals.

Similarly, the ceramic in the cermet of upper resistive layer 50 can be formed with ceramic materials other than silicon oxide. Candidate alternative ceramic materials include manganese oxide, titanium oxide, iron oxide, cobalt oxide, aluminum oxide, tantalum oxide, and magnesium fluoride. The primary requisite of the ceramic is that it be a good electrical insulator. Two or more different ceramics can be used in the cermet. Instead of cermet, layer 50 can be formed with large-bandgap semiconductor material.

A dielectric layer 52 overlies upper resistive layer 50. Dielectric layer 52 typically consists of silicon oxide having a thickness of 0.1–0.2 $\mu$m.

A group of laterally separated sets of electron-emissive elements 54 are situated in openings 56 extending through dielectric layer 52. Each set of electron-emissive elements 54 occupies an emission region that overlies a corresponding one of emitter electrodes 42. The particular elements 54 overlying each emitter electrode 42 are electrically coupled to that electrode 42 through resistive layer 46. Elements 54 can be shaped in various ways. In the example of FIG. 2, elements 54 are generally conical in shape and consist of electrically non-insulating material, typically a refractory metal such as molybdenum.

A group of composite generally parallel control electrodes 58 are situated on dielectric layer 52. Each control electrode 58 consists of a main control portion 60 and a group of adjoining gate portions 62 equal in number to the number of emitter electrodes 42. Main control portions 60 extend fully across the field emitter perpendicular to emitter electrodes 42. Gate portions 62 are partially situated in large control openings 64 extending through main portions 60. Each control opening 64 is sometimes referred to as a "sweet spot". Electron-emissive elements 54 are exposed through gate openings 66 in the segments of gate portions 62 situated in control openings 64. Main portions 60 typically consist of chromium having a thickness of 0.2 $\mu$m. Gate portions 62 typically consist of chromium having a thickness of 0.04 $\mu$m.

An electron focusing system 68, generally arranged in a waffle-like pattern as viewed perpendicularly to the upper surface of faceplate 40, is situated on the parts of main control portions 60 and dielectric layer 52 not covered by control electrodes 58. Focusing system 68 has a group of openings 70, one for each different set of electron-emissive elements 54. Electrons emitted from each set of electron-emissive elements 54 are focused by system 68 so as to impinge on phosphor material in a corresponding light-emissive element of the light-emitting device situated opposite the electron-emitting device. Focusing system 70 is typically implemented as described in Spindt et al, U.S. patent application Ser. No. 08/866,150, filed May 30, 1997 now allowed.

Figure 3:
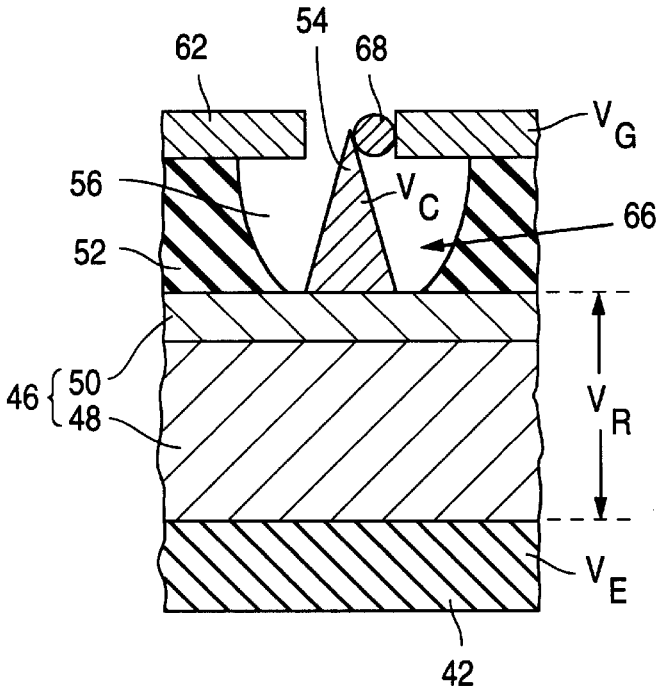
FIG. 3 is an expanded cross-sectional view of part of the electron-emitting device in FIG. 2 centered around one electron-emissive element and the underlying part of the vertical resistor.
Figure 4:
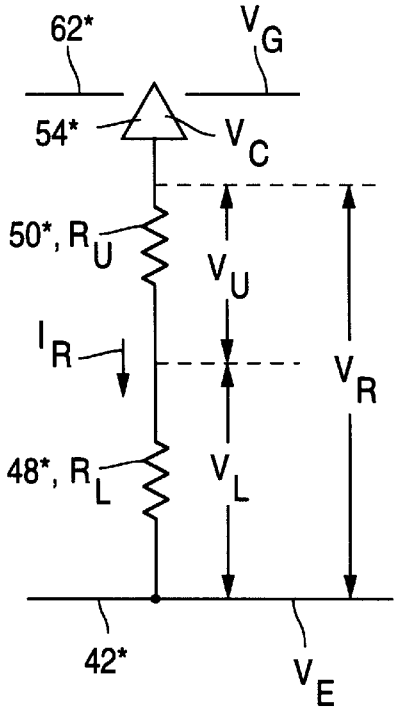
FIG. 4 is a circuit diagram of a simplified electrical model of the part of the electron-emitting device in FIG. 3.
Figure 5A:
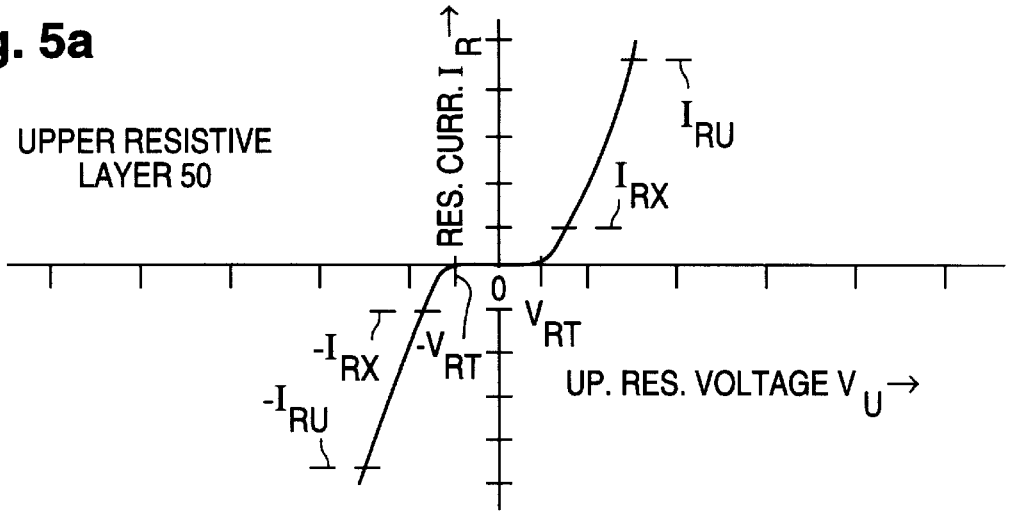
FIGS. 5*a,* 5*b,* and 5*c* are graphs of I–V characteristics for the electrical model of FIG. 4.
Figure 5B:
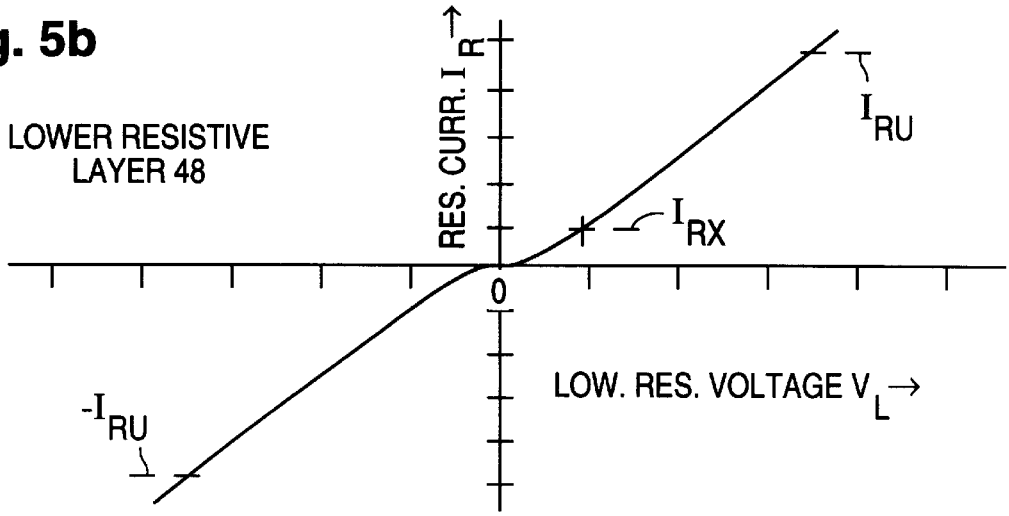
Figure 5C:
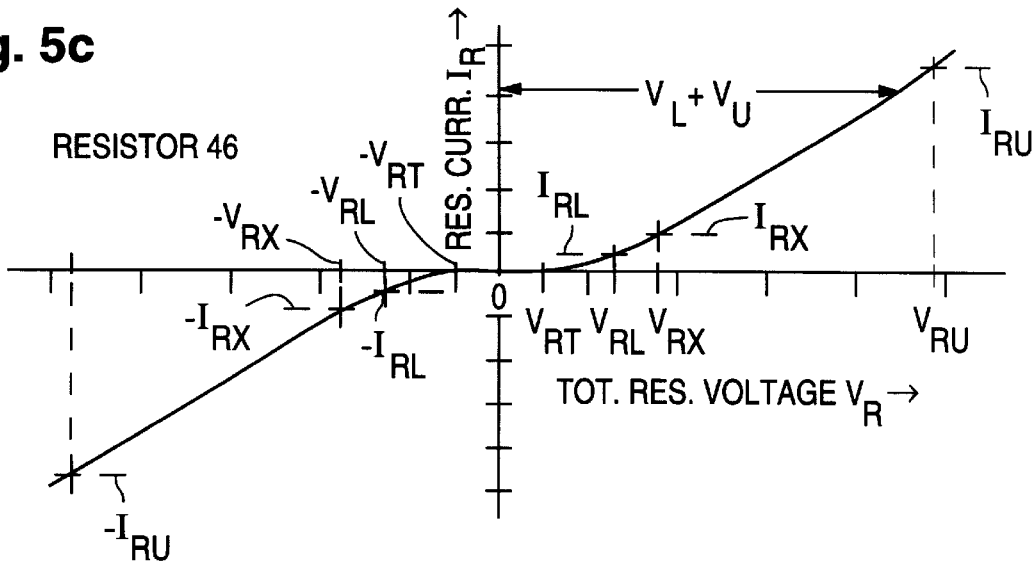

An understanding of how emitter resistor 46 is employed to help control current flow through electron-emissive elements 54 is facilitated with the assistance of FIGS. 3, 4, and 5*a*–5*c*. FIG. 3 presents an expanded view of a portion of the field emitter of FIG. 2 centered around one electron-emissive cone 54 and the underlying part of resistor 46. For exemplary purposes, cone 54 in FIG. 3 is shown as being electrically shorted to gate portion 62 by an electrically conductive particle 68. FIG. 4 presents a simplified electrical model of the field emitter portion depicted in FIG. 3. The reference symbol for each circuit element in FIG. 4 is formed with the reference symbol utilized for the corresponding physical element in FIG. 3 followed by an asterisk (*). FIGS. 5*a*–5*c* are simplified graphs for the respective vertical I–V characteristics of upper resistive layer 50, lower resistive layer 48, and composite vertical resistor 46.

A gate voltage $V_G$ is applied to gate portion 62 in FIG. 3. An emitter voltage $V_E$ is applied to emitter electrode 42. Raising gate-to-emitter voltage $V_G$–$V_E$ to a sufficiently high positive value causes conical electron-emissive element 54 to emit electrons, provided that cone 54 is not electrically shorted to gate portion 62 or otherwise disabled.

The electron emission from an unshorted cone 54 increases as gate-to-emitter voltage $V_G$–$V_E$ is increased. Different levels of brightness are established in the flat-panel display by adjusting voltage $V_G$–$V_E$ at each large control opening 64 to control the electron emission. The maximum value of $V_G$–$V_E$ is usually 5–200 volts, typically 35 volts.

A cone voltage $V_C$ is present on each electron-emissive cone 54. When gate-to-emitter voltage $V_G$–$V_E$ is non-zero, cone voltage $V_C$ lies between voltages $V_E$ and $V_G$, provided that cone 54 is not shorted to gate portion 62. Resistor voltage $V_R$ equals $V_C$–$V_E$. During normal operation of the field emitter, the voltage difference $V_G$–$V_C$ between gate portion 62 and an unshorted cone 54 constitutes the large majority of voltage $V_G$–$V_E$. For an unshorted cone 54, voltage $V_R$ across resistive layers 50 and 48 is thus small compared to voltage $V_G$–$V_E$. For example, resistor voltage $V_R$ for an unshorted cone 54 is typically 2 volts when voltage $V_G$–$V_E$ is at the typical maximum of 35 volts.

During normal operation of the flat-panel display, there can be instances in which a cone 54 is electrically shorted to its gate portion 62. Such an electrical short can occur as depicted in FIG. 3. A cone 54 can also be forced into direct contact with its gate portion 62 to form an electrical short to portion 62. In either case, cone voltage $V_C$ is approximately gate voltage $V_G$. Resistor voltage $V_R$ thus approximately equals $V_G$–$V_E$.

In other words, resistor 46 drops nearly all of gate-to-emitter voltage $V_G$–$V_E$. This drop can be as much as $V_{RU}$, typically 35 volts. The value of resistance $R_R$ is sufficiently high when voltage $V_R$ equals $V_{RU}$, the worst case, that current flowing downward through a shorted cone 54 and through resistor 46 is low enough to avoid excess power consumption and to avoid bringing gate voltage $V_G$ significantly close to emitter voltage $V_E$ and causing the brightness to be adversely affected in unshorted cones 54 subjected to the same $V_G$ and $V_E$ values as the shorted cone 54.

In the simplified electrical model of FIG. 4 (and in application of that model to the field emitter portion shown in FIG. 3), the variation that current spreading causes in the voltage along the interface between resistive layers 48 and 50 is ignored. Subject to this simplification, a lower resistor voltage $V_L$ is present across the thickness of lower resistive layer 48. An upper resistor voltage $V_R$ is similarly present across the thickness of upper resistive layer 50. Resistor voltage $V_R$ is then given approximately as:

$$V_R = V_L + V_U \quad (1)$$

A resistor current $I_R$ flows through the thicknesses of resistive layers 48 and 50. Even though spreading occurs in resistor current $I_R$, it is primarily a vertical current. Current $I_R$ is determined from the relationship:

$$V_R = I_R R_R \quad (2)$$

where overall resistance $R_R$ is approximately the sum of lower resistance $R_L$ any upper resistance $R_U$. In the simplified model of FIGS. 3 and 4, voltages $V_L$ and $V_U$ are given as:

$$V_L = I_R R_L \quad (3)$$

$$V_U = I_R R_U \quad (4)$$

When cone 54 is an unshorted cone emitting electrons, resistor current $I_R$ flows generally downward through cone 54 and then downward through layers 48 and 50 as qualitatively indicated in FIG. 4. Current $I_R$ also flows downward through cone 54 and layers 48 and 50 when cone 54 is shorted to gate portion 62 during normal display operation.

FIGS. 5*a* and 5*b* illustrate qualitatively how resistor current $I_R$ varies respectively with (a) voltage $V_U$ across upper resistive layer 50 and (b) voltage $V_L$ across lower resistive layer 48. Lower current $I_{RL}$ and upper current $I_{RU}$ are the values of current $I_R$ respectively at operating voltage levels $V_{RL}$ and $V_{RU}$. As FIGS. 5*a* and 5*b* show, the vertical I–V characteristics of lower resistive layer 48 are more linear than the vertical I–V characteristics of upper resistive layer 50 for current $I_R$ varying from zero to (at least) upper operating value $I_{RU}$.

The I–V curve of upper resistive layer 50 makes a sharp bend when upper resistor voltage $V_U$ is in the vicinity of transition value $V_{RT}$. The bend in the I–V curve of upper resistive layer 50 is sufficiently great that the I–V curves of resistive layers 48 and 50 cross over each other when resistor current $I_R$ is at a crossover value $I_{RX}$. In particular, upper resistance $R_U$ is greater than lower resistance $R_L$ for current $I_R$ between zero and $I_{RX}$. For current $I_R$ between $I_{RX}$ and $I_{RU}$, lower resistance $R_L$ is greater than upper resistance $R_U$.

FIG. 5*c* illustrates qualitatively how resistor current $I_R$ varies with resistor voltage $V_R$. At crossover current $I_{RX}$, resistor voltage $V_R$ is at a crossover value $V_{RX}$. In terms of crossover value $V_{RX}$, lower resistance $R_L$ (a) is less than upper resistance $R_U$ when voltage $V_R$ is between zero and $V_{RX}$ and (b) is greater than resistance $R_U$ when voltage $V_R$ is between $V_{RX}$ and $V_{RU}$. Since lower-resistor voltage $V_L$ equals upper-resistor voltage $V_U$ at the crossover point, each of voltages $V_L$ and $V_U$ equals $V_{RX}/2$ at the crossover point.

FIG. 5*c* illustrates crossover voltage $V_{RX}$ as occurring at a greater value of resistor voltage $V_R$ than lower operating voltage $V_{RL}$. Alternatively, $V_{RL}$ can occur at a greater $V_R$ value than $V_{RX}$. Similar comments apply to current values $I_{RX}$ and $I_{RL}$. In some situations, the I–V curves of resistive layers 48 and 50 could cross over at $V_R$ and $I_R$ values respectively greater than $V_{RU}$ and $I_{RU}$.

In general, the I–V characteristics of resistor 46 become progressively more linear as resistor voltage $V_R$ increases from $V_{RT}$ through $V_{RL}$ and $V_{RX}$ up to $V_{RU}$. FIGS. 5*a*–5*c* also illustrate the symmetries of the $V_U$, $V_L$, and $V_R$ variations about the origin. In the third quadrant of FIG. 5*c*, lower resistance $R_L$ (a) is less than upper resistance $R_U$ when voltage $V_R$ is approximately between zero and $-V_{RX}$ and (b) is greater than resistance $R_U$ when voltage $V_R$ is between $-V_{RX}$ and $-V_{RU}$.

For given compositions of resistive layers 48 and 50, the vertical I–V characteristics of resistor 46 can be controlled by adjusting the thickness of layer 48 relative to the thickness of layer 50. In doing so, the value of crossover voltage $V_{RX}$ normally changes. The value of transition voltage $V_{RT}$, mainly determined by upper resistor layer 50, may change if the thickness of upper layer 50 is adjusted in changing the thickness ratio of layer 48 to layer 50.

Subject to changes in values $V_{RX}$ and $V_{RT}$, the vertical I–V characteristics of resistor 46 in the $V_R$ range from $V_{RT}$ to $V_{RU}$ become progressively closer to the vertical I–V characteristics of lower resistive layer 48 and thus progressively more linear, as the thickness of layer 48 increases relative to that of layer 50. The minimum thickness of layer 50 is largely determined by processing conditions and short-circuit factors. It is usually desirable that transition voltage $V_{RT}$ be as small as processing conditions permit.

Figure 1:
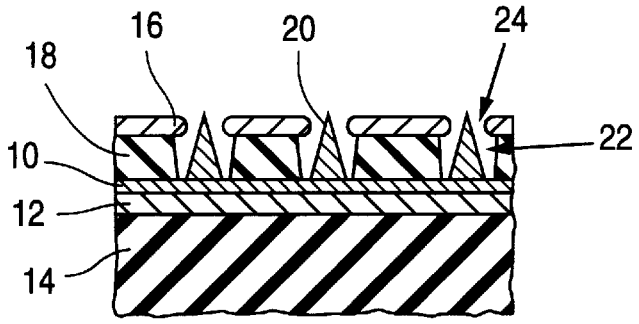
Fig. 1 PRIOR ART
FIG. 1 is a cross-sectional view of the core of a conventional electron-emitting device.
Figure 6A:
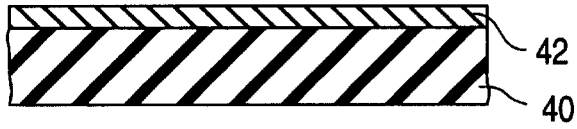
FIGS. 6*a,* 6*b,* 6*c,* 6*d,* and 6*e* are cross-sectional views representing steps in manufacturing the electron-emitting device of FIG. 2.
Figure 6B:
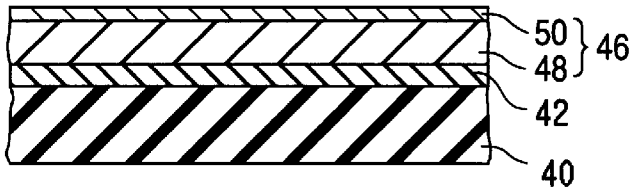
Figure 6C:
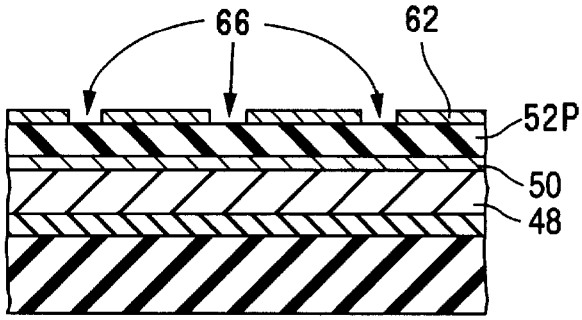

FIGS. 6*a*–6*e* (collectively "FIG. 6") generally illustrate a process for manufacturing the field emitter of FIG. 1. FIG. 6 only depicts the fabrication of the components which, as viewed vertically, are located within the lateral boundary of one large control opening (sweet spot) 64. The starting point is baseplate 40. A blanket layer of the emitter electrode material is deposited on baseplate 40 and patterned using a photoresist mask to produce emitter electrodes 42 as depicted in FIG. 6*a*.

A sputter etch is typically performed to clean the exposed surfaces of emitter electrodes 42. Lower resistive layer 48 is deposited on electrodes 42 and on the exposed portions of baseplate 40. See FIG. 6*b*. The deposition of layer 48 is typically performed by sputtering so that layer 48 make good ohmic contact to electrodes 42. Layer 48 can alternatively be deposited by chemical vapor deposition ("CVD").

Upper resistive layer 50 is then deposited on lower resistive layer 48. The deposition of upper resistive layer 50 is typically performed by sputtering. Layer 50 can alternatively be deposited by CVD.

A blanket dielectric layer 52P of silicon oxide is deposited on upper resistive layer 50. See FIG. 6*c*. The silicon oxide of dielectric layer 52P is selectively etchable with respect to the cermet of upper resistive layer 50. The deposition of layer 52P is typically performed by CVD.

A blanket layer of the electrically conductive material for main control portions 60 (not shown in FIG. 6) is deposited on dielectric layer 52P and patterned using a photoresist mask to form control portions 60, including large control openings 64 (also not shown in FIG. 6). A blanket layer of the desired gate material is deposited on top of the structure and patterned using another photoresist mask to form gate portions 62. If main control portions 60 are to partially underlie gate portions 62 rather than partially overlie gate portions 62, gate portions 62 are formed before main control portions 60. In either case, gate openings 66 are typically created through gate portions 62 according to a charged-particle tracking procedure of the type described in U.S. Pat. Nos. 5,559,389 or 5,564,959.

Figure 6D:
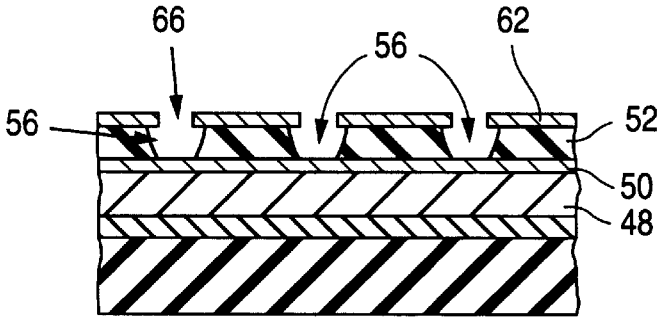

Using gate portions 62 as an etch mask, dielectric layer 52P is etched through gate openings 66 to form dielectric openings 56. FIG. 6*d* shows the resulting structure. Inter-electrode dielectric layer 52 is the remainder of layer 52P. During the etch, upper resistive layer 50 serves as an etch stop to prevent the etchant from attacking lower resistive layer 48 and emitter electrodes 42.

The etch to create dielectric openings 56 is normally performed in such a manner that openings 56 undercut gate layer 62 somewhat. The amount of undercutting is sufficiently great to avoid having the later-deposited emitter cone material accumulate on the sidewalls of openings 56 and short the electron emissive elements to gate layer 62.

The interelectrode dielectric etch can be performed in various ways such as: (a) an isotropic wet etch using one or more chemical etchants, (b) an undercutting (and thus not fully anisotropic) dry etch, and (c) a non-undercutting (fully anisotropic) dry etch followed by an undercutting etch, wet or dry. When dielectric layer 52 consists of silicon oxide, the etch is preferably done in two stages. An anistropic etch is performed with a fluorine-based plasma, typically a $CHF_3$ plasma, to create vertical openings substantially through layer 52 after which an isotropic wet etch is performed with buffered hydrofluoric acid to widen the initial openings and form dielectric openings 56. Upper resistive layer 50 is an etch stop during both etch stages.

Figure 6E:
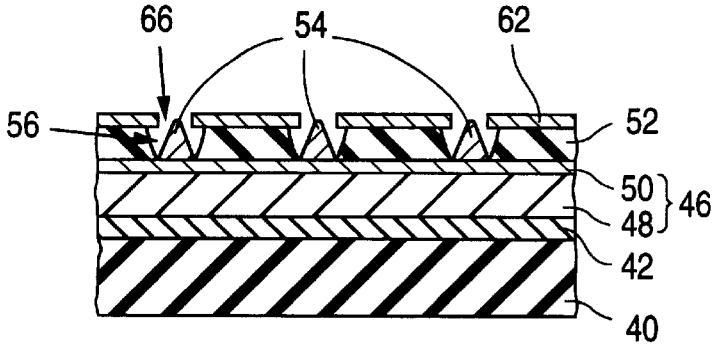

Electron-emissive cones 54 are now formed in dielectric openings 56. Various techniques can be employed to create cones 54. In one technique, the desired emitter cone material, e.g., molybdenum, is evaporatively deposited on top of the structure in a direction generally perpendicular to the upper surface of dielectric layer 52. The emitter cone material accumulates on gate layer 62 and passes through gate openings 66 to accumulate on upper resistive layer 50 in dielectric openings 56. Due to the accumulation of the cone material on gate layer 62, the openings through which the cone material enters openings 56 progressively close. The deposition is performed until these openings fully close. As a result, the cone material accumulates in openings 56 to form corresponding conical electron-emissive elements 54 as shown in FIG. 6*e*. A continuous (blanket) layer (not shown in FIG. 6*e*) of the cone material is simultaneously formed on gate layer 62.

The (unshown) layer of excess emitter cone material is removed electrochemically to produce the structure shown in FIG. 6*e*. The electrochemical removal of the excess cone material layer can be performed according to the technique described in Knall et al, co-filed U.S. patent application Ser. No. 08/884,700, now allowed the contents of which are incorporated by reference herein.

The electrochemical removal of the excess cone material layer is performed in an electrochemical cell (not shown here). Some of electron-emissive cones 54 typically become electrically shorted to gate layer 62 before and/or during removal of the excess cone material. In utilizing the techniques of Knall et al to remove the excess cone material layer, the electrochemical cell is operated in such a manner that resistor voltage $V_R$ is negative for unshorted cones 54 but not more negative than negative transition value $-V_{RT}$, i.e., voltage $V_R$ is between $-V_{RT}$ and zero. This is one of the regimes where resistance $R_U$ of upper resistive layer 50 is very high. In particular, upper resistance $R_U$ is sufficiently high that unshorted cones 54 are effectively electrically isolated from each shorted cone 54. The high $R_U$ value in this regime prevents unshorted cones 54 from being raised to the electrochemical removal potential present on the excess cone material layer by virtue of a short-circuit path through a shorted cone 54.

If means are provided to maintain unshorted cones 54 at a sufficiently negative potential relative to the electrochemical removal potential, unshorted cones 54 are not electrochemically attacked. If the potential on any unshorted cone 54 can attain a value close to the electrochemical removal potential, the removal value of current $I_R$ flowing through each unshorted cone 54 is so small that very little material of that unshorted cone 54 is removed during the time period needed to remove the layer of excess cone material. The net result is that unshorted cones 54 are not removed or significantly attacked as an unintended consequence of removing the excess cone material layer.

A lift-off technique can alternatively be employed to remove the excess cone material layer. This entails depositing a lift-off layer on top of gate layer 62 before depositing the cone material. An excess cone material layer forms on the lift-off layer during the cone deposition. The lift-off layer is subsequently removed, thereby simultaneously lifting off the excess cone material layer.

Regardless of the technique employed to remove the layer of excess cone material, the presence of upper resistive layer 50 enables the excess cone material to be removed without galvanic corrosion that could blunt the tips of cones 54 or/and cause some of cones 54 to become disconnected from resistor 46. The cermet of upper resistive layer does not itself cause galvanic corrosion of cones 54 when cones 54 are situated in an electrolytic solution during, for example, the electrochemical removal of the excess cone material. The cermet acts as a barrier to prevent galvanic corrosion of cones 54 that might otherwise occur due to galvanic interaction with lower resistive layer 48 or emitter electrodes 42. Furthermore, cones 54 adhere well to the cermet in upper resistive layer 50.

Focusing system 68 (not shown in FIG. 6) is created according to a backside/frontside exposure procedure as described in Spindt et al, cited above. During the backside exposure utilized in Spindt et al, advantage is taken of a fact that resistor 46 transmits a substantial percentage, typically 40–80%, of light, including ultraviolet light, incident on resistor 46.

In subsequent operations, the field emitter is sealed to the light-emitting device through an outer wall. The sealing operation typically entails mounting the outer wall, along with spacer walls, on the light-emitting device. This composite assembly is then brought into contact with the field emitter and hermetically sealed in such a manner that the internal display pressure is typically $10^{-7}$–$10^{-6}$ torr.

In a field emitter having control electrodes separated from emitter electrodes by dielectric material, a cross-over short circuit occurs when a control electrode becomes electrically connected directly to an emitter electrode through the dielectric material. If a resistor is also present between the emitter electrode and the control electrode, the cross-over short is produced by electrically conductive material extending through both the dielectric material and the resistor to connect the two electrodes. The conductive material can be a separate electrically conductive particle or material of one or both of the two electrodes.

When upper resistive layer 50 in the present field emitter is formed with cermet, the occurrence of cross-over short circuits is greatly reduced even though cross-over shorts could occur in a field emitter that lacks upper resistive layer 50 but contains lower resistive layer 48 and is otherwise comparable to the present field emitter, including having a total resistor thickness of approximately the same thickness as resistor 46. Upper resistive layer 50 functions as a barrier that prevents cross-over shorts in the invention.

A flat-panel CRT display containing an electron-emitting device manufactured according to the invention operates in the following way. The light-emitting device has an anode layer situated over the light-emissive phosphor elements and maintained at high positive potential relative to control electrodes 58 and emitter electrodes 42. When a suitable potential is applied between (a) a selected one of control electrodes 58 and (b) a selected one of emitter electrodes 42, the so-selected gate portion 62 extracts electrons from the selected set of electron-emissive elements 54 and controls the magnitude of the resulting electron current. Desired levels of electron emission typically occur when the applied gate-to-cathode parallel-plate electric field reaches 20 volts/$\mu$m or less at a current density of 0.1 mA/cm$^2$ as measured at the light-emissive elements when they are high-voltage phosphors. The extracted electrons pass through the anode layer and selectively strike the phosphor elements, causing them to emit light visible on the exterior surface of the light-emitting device.

Directional terms such as "top", "upper", and "lower" have been employed in describing the present invention to establish a frame of reference by which the reader can more easily understand how the various parts of the invention fit together. In actual practice, the components of the present electron-emitting device may be situated at orientations different from that implied by the directional items used here. The same applies to the way in which the fabrication steps are performed in the invention. Inasmuch as directional items are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For instance, resistor 46 can be formed with more than two resistive layers. Resistor 46 can be patterned rather than being in the form of a blanket layer. Part of resistor 46, such as upper layer 50, can be a blanket layer while the remainder of resistor 46 is patterned.

Each of the sets of electron-emissive elements 54 can consist of only one element 54 rather than multiple elements 54. Multiple electron-emissive elements can be situated in one opening through dielectric layer 52. Electron-emissive elements 54 can have shapes other than cones. One example is filaments, while another is randomly shaped particles such as diamond grit.

The principles of the invention can be applied to other types of matrix-addressed flat-panel displays. Candidate flat-panel displays for this purpose include matrix-addressed plasma displays and active-matrix liquid-crystal displays. In general, the present multi-layer resistor can be employed to prevent galvanic corrosion during the fabrication of a wide variety of multi-electrode devices. Various modifications and applications may thus be made by those skilled in the art without departing from the true scope and spirit of the invention as defined in the appended claims.

We claim:

1. A device comprising:

an electrically conductive emitter electrode;

a lower electrically resistive layer overlying the emitter electrode;

an upper electrically resistive layer overlying, and of different chemical composition than, the lower resistive layer; and a set of electron-emissive elements overlying the upper resistive layer, each resistive layer extending continuously from a location below each electron-emissive element to a location below each other electron-emissive element.

2. A device as in claim 1 wherein current-voltage characteristics of a specified one of the resistive layers are closer to linear than current-voltage characteristics of the remaining one of the resistive layers for a resistor voltage across the two layers varying from zero to at least an upper operating value that the resistor voltage can reach during normal operation of the device.

3. A device as in claim 2 wherein the specified resistive layer (a) is of lower resistance than the remaining resistive layer when the resistor voltage is between zero and a crossover value less than the upper operating value and (b) is of higher resistance than the remaining resistive layer when the resistor voltage is between the crossover value and the upper operating value.

4. A device as in claim 2 wherein the remaining resistive layer is of resistance that changes by at least a factor of 10 with the resistor voltage.

5. A device as in claim 2 wherein the specified resistive layer is the lower resistive layer, the remaining resistive layer thereby being the upper resistive layer.

6. A device as in claim 5 wherein the lower resistive layer (a) is of lower resistance than the upper resistive layer when the resistor voltage is between zero and a crossover value less than the upper operating value and (b) is of higher resistance than the upper resistive layer when the resistor voltage is between the crossover value and the upper operating value.

7. A device as in claim 6 wherein the upper resistive layer is of resistance at least 10 times lower when the resistor voltage is at the upper operating value than when the resistor voltage is at a transition value between zero and the crossover value.

8. A device as in claim 6 wherein current-voltage characteristics of the two resistive layers as a combination became progressively more linear as the resistor voltage increases from the transition value through the crossover value to the upper operating value.

9. A device as in claim 6 wherein, when the resistor voltage is between the transition value and the upper operating value, current-voltage characteristics of the two resistive layers as a combination become progressively more linear as the lower resistive layer is made progressively thicker relative to the upper resistive layer.

10. A device as in claim 1 wherein the upper resistive layer comprises cermet in which metal particles are embedded in ceramic.

11. A device as in claim 10 wherein:

the metal particles consist of 10–80% of the cermet by weight; and the ceramic consists of 20–90% of the cermet by weight.

12. A device as in claim 10 wherein the metal particles comprise chromium particles.

13. A device as in claim 10 wherein the lower resistive layer comprises a silicon-carbon compound.

14. A device as in claim 1 further including a dielectric layer overlying the upper resistive layer and having at least one dielectric opening in which the electron-emissive elements are situated.

15. A device as in claim 14 wherein the dielectric layer is selectively etchable with respect to the upper resistive layer.

16. A device as in claim 14 further including a control electrode overlying the dielectric layer and having at least one control opening that exposes the electron-emissive elements.

17. A device comprising:

a plurality of laterally separated electrically conductive emitter electrodes;

a lower electrically resistive layer overlying the emitter electrodes;

an upper electrically resistive layer overlying, and of different chemical composition than, the lower resistive layer; and a plurality of laterally separated sets of electron-emissive elements overlying the upper resistive layer, each set containing multiple electron-emissive elements, each resistive layer extending continuously from a location below each electron-emissive element in each set to a location below each other electron-emissive element in that set.

18. A device as in claim 17 further including:

a dielectric layer overlying the upper resistive layer and having dielectric openings in which the electron-emissive elements are situated; and a plurality of laterally separated control electrodes overlying the dielectric layer and having control openings through which the electron-emissive elements are exposed.

19. A device as in claim 18 wherein the upper resistive layer comprises cermet in which metal particles are embedded in ceramic.

20. A device as in claim 18 further including anode means situated above, and spaced apart from, the electron-emissive elements for collecting electrons emitted by the electron-emissive elements, the anode means being part of a light-emitting device having a like multiplicity of laterally separated light-emissive elements situated respectively opposite the sets of electron-emissive elements for emitting light upon being struck by electrons emitted from the electron-emissive elements.

21. A device comprising:

an electrically conductive emitter electrode;

a lower electrically resistive layer overlying the emitter electrode;

an upper electrically resistive layer overlying, and of different chemical composition than, the lower resistive layer, the upper resistive layer comprising cermet in which metal particles are embedded in ceramic; and an electron-emissive element overlying the upper resistive layer.

22. A device as in claim 21 wherein:

the metal particles consist of 10–80% of the cermet by weight; and the ceramic consists of 20–90% of the cermet by weight.

23. A device as in claim 21 wherein the metal particles comprise chromium particles.

24. A device as in claim 21 wherein the lower resistive layer comprises at least one of a silicon-carbon compound, aluminum nitride, gallium nitride, and amorphous silicon.

25. A device as in claim 21 wherein current-voltage characteristics of the lower resistive layer are closer to linear than current-voltage characteristics of the upper resistive layer for a resistor voltage across the two layers varying from zero to at least an upper operating value that the resistor voltage can reach during normal operation of the device.

26. A device as in claim 25 wherein the lower resistive layer (a) is of lower resistance than the upper resistive layer when the resistor voltage is between zero and a crossover value less than the upper operating value and (b) is of higher resistance than the upper resistive layer when the resistor voltage is between the crossover value and the upper operating value.

27. A device as in claim 26 wherein the upper resistive layer is of resistance at least 10 times lower when the resistor voltage is at the upper operating value than when the resistor voltage is at a transition value between zero and the crossover value.

28. A device as in claim 26 wherein current-voltage characteristics of the two resistive layers as a combination became progressively more linear as the resistor voltage increases from the transition value through the crossover value to the upper operating value.

29. A device as in claim 26 wherein, when the resistor voltage is between the transition value and the upper operating value, current-voltage characteristics of the two resistive layers as a combination become progressively more linear as the lower resistive layer is made progressively thicker relative to the upper resistive layer.

30. A device as in claim 21 further including a dielectric layer overlying the upper resistive layer and having a dielectric opening in which the electron-emissive element is situated.

31. A device as in claim 30 wherein the dielectric layer is selectively etchable with respect to the upper resistive layer.

32. A device as in claim 30 further including a control electrode overlying the dielectric layer and having a control opening that exposes the electron-emissive element.

* * * * *